US009894429B2

(12) United States Patent
Risberg et al.

(10) Patent No.: US 9,894,429 B2
(45) Date of Patent: Feb. 13, 2018

(54) ENHANCING AUDIO PERFORMANCE OF A CONSUMER ELECTRONIC DEVICE BY PRODUCING COMPENSATION PARAMETERS BASED ON THE ACOUSTIC SIGNATURE OF THE DEVICE

(71) Applicant: CIRRUS LOGIC INTERNATIONAL SEMICONDUCTOR LTD., Edinburgh (GB)

(72) Inventors: Pär Gunnars Risberg, Solna (SE); Landy Toth, Doylestown, PA (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/159,311

(22) Filed: May 19, 2016

(65) Prior Publication Data

US 2016/0261938 A1 Sep. 8, 2016

Related U.S. Application Data

(62) Division of application No. 14/371,009, filed as application No. PCT/US2013/020739 on Jan. 9, 2013, now abandoned.

(Continued)

(51) Int. Cl.

*H04R 1/02* (2006.01)
*H04R 1/20* (2006.01)

(Continued)

(52) U.S. Cl.

CPC ..... *H04R 1/025* (2013.01); *H04R 1/028* (2013.01); *H04R 1/2811* (2013.01);

(Continued)

(58) Field of Classification Search

CPC ..... H04R 1/02; H04R 1/025; H04R 1/026; H04R 1/345; H04R 1/2811; H04R 1/2815;

(Continued)

(56) References Cited

U.S. PATENT DOCUMENTS 6,246,763 B1 6/2001 Dufosse
6,496,586 B1 12/2002 Hayes et al.

(Continued)

FOREIGN PATENT DOCUMENTS

CN 1241083 A 1/2000
CN 1658622 A 8/2005

(Continued)

OTHER PUBLICATIONS

Chinese Office Action issued in corresponding Application No. CN2013800050076 dated Oct. 9, 2016, 6 pages.

(Continued)

*Primary Examiner* — Katherine Faley

(74) *Attorney, Agent, or Firm* — Carter, DeLuca, Farrell & Schmidt, LLP

(57) ABSTRACT

An integrated loudspeaker assembly along with associated methods and systems for enhancing audio output from a consumer electronic device including such an integrated loudspeaker assembly are disclosed. More particularly an integrated loudspeaker assembly configured to utilize the enclosure of an associated consumer electronic device for back volume is disclosed. Methods and systems for optimizing the audio performance of a consumer electronic device with an integrated loudspeaker assembly are also disclosed.

15 Claims, 6 Drawing Sheets

Related U.S. Application Data

(60) Provisional application No. 61/584,473, filed on Jan. 9, 2012.

(51) Int. Cl.
*H04R 1/28* (2006.01)
*H04R 3/04* (2006.01)
*H04R 29/00* (2006.01)
*H04R 1/34* (2006.01)

(52) U.S. Cl.
CPC ..... *H04R 1/2815* (2013.01); *H04R 1/2873* (2013.01); *H04R 1/345* (2013.01); *H04R 3/04* (2013.01); *H04R 29/001* (2013.01); *H04R 1/021* (2013.01); *H04R 1/288* (2013.01); *H04R 1/2896* (2013.01); *H04R 2201/028* (2013.01); *H04R 2201/029* (2013.01); *H04R 2499/11* (2013.01); *H04R 2499/15* (2013.01)

(58) Field of Classification Search
CPC .... H04R 1/2873; H04R 3/04; H04R 2201/02; H04R 2201/029; H04R 2499/11; H04R 2499/15
USPC ..... 381/333, 334, 345, 386, 388, 395; 379/433.02
See application file for complete search history.

(56) References Cited

U.S. PATENT DOCUMENTS

| | | | | |
|---|---|---|---|---|
| 6,804,362 | B1 | 10/2004 | Zimmermann et al. | |
| 8,838,445 | B1 | 9/2014 | Bultemeier | |
| 2003/0204277 | A1 | 10/2003 | Achariyakosol et al. | |
| 2005/0205350 | A1 | 9/2005 | Yang | |
| 2007/0147646 | A1* | 6/2007 | Klein | H04M 1/035 381/338 |
| 2008/0059170 | A1* | 3/2008 | Bloebaum | G06F 17/30746 704/233 |
| 2009/0136075 | A1* | 5/2009 | Meyer | H04R 9/063 381/386 |
| 2009/0304211 | A1 | 12/2009 | Tashev et al. | |
| 2011/0222696 | A1 | 9/2011 | Balachandran et al. | |
| 2012/0002823 | A1* | 1/2012 | Kanishima | H03G 9/025 381/98 |
| 2012/0214544 | A1 | 8/2012 | Shivappa et al. | |

FOREIGN PATENT DOCUMENTS

| | | | |
|---|---|---|---|
| DE | 3512944 | A1 | 10/1986 |
| EP | 3967772 | A1 | 12/1999 |
| EP | 1496671 | A1 | 1/2005 |
| GB | 2412268 | A | 9/2005 |
| JP | 2002077346 | A | 3/2002 |
| KR | 20050093654 | A | 9/2005 |
| WO | 97/00592 | A2 | 1/1997 |
| WO | 2007/085305 | A1 | 8/2007 |
| WO | 2011/110901 | A1 | 9/2011 |

OTHER PUBLICATIONS

International Search Report issued in corresponding application No. PCT/U52013/020739 dated Apr. 29, 2013.
Supplementary European Search Report for EP 13 73 5717 dated Jul. 16, 2015.
Office Action issued in corresponding Chinese Application No. 2013800050076 dated May 15, 2017.

* cited by examiner

ENHANCING AUDIO PERFORMANCE OF A CONSUMER ELECTRONIC DEVICE BY PRODUCING COMPENSATION PARAMETERS BASED ON THE ACOUSTIC SIGNATURE OF THE DEVICE

CROSS-REFERENCE TO RELATED APPLICATION

The present application is a Divisional application of U.S. patent application Ser. No. 14/371,009 filed on Jul. 8, 2014, which is a U.S. National Stage Application claiming the benefit of and priority to PCT International Application No. PCT/US2013/020739 filed Jan. 9, 2013, which claims the benefit of and priority to U.S. Provisional Application No. 61/584,473 filed on Jan. 9, 2012, the entire contents of each of which are incorporated by reference herein.

BACKGROUND

Technical Field

The present disclosure is directed to systems and methods for improving audio output from consumer electronic devices. More precisely, the disclosure is directed towards integrated loudspeaker assemblies and associated audio processing systems and methods for enhancing audio from devices with highly constrained form factors. The present disclosure is also directed towards systems and methods for optimizing such audio processing systems as part of a design and/or manufacturing process.

Background

Mobile technologies and consumer electronic devices (CED) continue to expand in use and scope throughout the world. In parallel with continued proliferation, there is rapid technical advance of device hardware and components, leading to increased computing capability and incorporation of new peripherals onboard a device along with reductions in device size, power consumption, etc.

Audio experience is one of many factors considered in the design of consumer electronic devices. Often, the quality of audio systems, loudspeakers, etc. are compromised in favor of other design factors such as cost, visual appeal, form factor, screen real-estate, case material selection, hardware layout, and assembly considerations amongst others.

Audio subassemblies, including loudspeakers, connectors, filters, gaskets, waveguides, mounting hardware, and/or drivers are generally fabricated and tested to specification by one or more component suppliers and then assembled into consumer electronic devices by a device assembly manufacturer. As such, by the nature of this business practice, the audio subassemblies include aspects such as self-contained speaker enclosures that may add unnecessary material and size to the components. Simultaneously, the design of such audio subassemblies may be highly compromised due to the size and space limitations allotted for the subassembly within a consumer electronic device.

FIG. 1 shows an example of a conventional loudspeaker assembly for use within a consumer electronic device 1. The loudspeaker assembly includes a speaker housing 120 and a speaker unit 110 attached thereto by a support 122. The speaker housing 120 includes a self-contained back volume 140 of predetermined size. The loudspeaker assembly is fabricated to specification at a first location and placed into the consumer electronic device 1 at a second location. The consumer electronic device 10 generally includes a casing 2 with perforations 4 there through to communicate sound from an internally placed loudspeaker assembly to a surrounding environment. The loudspeaker assembly is generally attached to the casing 2 with a mounting adhesive 124 such that the speaker unit 110 is placed in fluid communication with the perforations 4 for operable production of audio output 5. The casing 2 also includes space 3 for components. Such space 3 is not available for use as back volume for the loudspeaker unit 110.

SUMMARY

One objective of this disclosure is to provide an integrated loudspeaker assembly, associated methods and systems for enhancing audio output from a consumer electronic device.

Another objective is to provide an integrated loudspeaker assembly of reduced size, cost and/or complexity for use in a consumer electronic device.

Yet another objective is to provide methods and systems for optimizing performance of an integrated loudspeaker assembly in a consumer electronic device.

The above objectives are wholly or partially met by devices, systems, and methods according to the appended claims in accordance with the present disclosure. Features and aspects are set forth in the appended claims, in the following description, and in the annexed drawings in accordance with the present disclosure.

According to a first aspect there is provided, a consumer electronic device including a casing, the casing defining an enclosure, and an integrated loudspeaker assembly placed within the enclosure. The casing includes one or more perforations with the perforations organized to communicate an audio signal across the casing to a surrounding environment. The integrated loudspeaker assembly includes a speaker unit and a mounting support. The mounting support is configured to attach the speaker unit to the casing so as to substantially acoustically isolate the perforations from the rest of the enclosure. The enclosure contributes a back volume for the speaker unit.

By "enclosure" is meant the region within the casing of the consumer electronic device. It may be available to various components (e.g. mechanical components, electrical components, etc.), the integrated loudspeaker assembly, etc. The exact portion of the enclosure available for use as a back volume may be indeterminate during the design phase of the consumer electronic device.

The back volume available for use by the speaker unit as well as the acoustic properties of the back volume and associated surfaces may be essentially unknown until final assembly of the consumer electronic device, as other components (e.g. chipsets, PCBs, displays, etc.) may also consume space within the enclosure. In addition, component placement, mounting methods, manufacturing variability, and the like may also influence the acoustical properties of the consumer electronic device. Even late stage manufacturing decisions such as changes in the amount of adhesive used to mount structural element, may significantly influence the acoustic properties of the resulting consumer electronic device.

The speaker unit may include an electromagnetic, thermoacoustic, electrostatic, magnetostrictive, ribbon, array type, and/or electroactive material based speaker element. In one non-limiting example the speaker unit may include an electroactive material based speaker (e.g. a film speaker). The film speaker may include a ferroelectric polymer (e.g. a piezoelectric polymer, an electrostrictive polymer, a dielectric elastomeric polymer, a graft elastomer, a high dielectric permittivity thermoplastic elastomer, etc.), an electret, a piezoceramic structure, or the like. Such speaker units may be suitable for producing the audio signal from an input signal (e.g. as provided by a source within the consumer electronic device).

The integrated loudspeaker assembly may be attached to the casing at a plurality of points to enhance the structural rigidity thereof and/or vibrational-acoustic coupling thereto. The integrated loudspeaker assembly may include a protruding member that protrudes through the casing so as to provide a supporting leg for the consumer electronic device. The protruding member may be configured to transfer vibration from the speaker unit to an external support surface located outside the consumer electronic device. Such a configuration may be advantageous for recruitment of one or more supporting surfaces to increase the surface area available for sound reproduction from the consumer electronic device.

The integrated loudspeaker assembly may include a waveguide for communicating the audio signal from the speaker unit to the perforations.

The integrated loudspeaker assembly may have a thickness. In aspects, the integrated loudspeaker assembly may be made exceptionally thin. The thickness may be less than 3 mm thick, less than 2 mm thick, less than 1 mm thick.

The consumer electronic device may include an audio enhancement system (AES) in accordance with the present disclosure, configured to accept an input signal from a source located within the consumer electronic device and to communicate an output signal to the speaker unit. The audio enhancement system may be configured to compensate for the back volume in the output signal.

The audio enhancement system (AES) may include a parametrically configurable processing (PCP) block configured (i.e. programmed, designed, hardware configured, etc.) to provide the compensation of the back volume. In aspects, the AES may include one or more reconfigurable parameters for adjusting the compensation of the back volume.

Some non-limiting examples of a consumer electronic device in accordance with the present disclosure include a cellular phone, a tablet computer, a laptop computer, a portable media player, a television, a portable gaming device, a gaming console, a gaming controller, a remote control, an appliance, a power tool, a robot, a toy, a home entertainment system, and the like.

According to another aspect there is provided a tuning rig for optimizing the acoustic performance of a consumer electronic device in accordance with the present disclosure. The tuning rig includes an acoustic test chamber configured to accept the consumer electronic device, one or more microphones placed within the acoustic test chamber, a mounting boom within the acoustic test chamber to receive the consumer electronic device, and a workstation. The workstation may be placed in operable communication with the consumer electronic device and the microphones, configured to deliver one or more audio test signals to the consumer electronic device, to receive one or more measured signals from the microphones and/or the consumer electronic device, and to update one or more audio algorithms and/or parameters on the consumer electronic device.

The workstation may be configured to communicate one or more of the audio test signals, one or more measured signals, and/or identification information pertaining to the consumer electronic device to a cloud based datacenter and/or receive one or more audio enhancement parameters from the cloud based datacenter and to program the consumer electronic device with the audio enhancement parameters.

In aspects, the consumer electronic device may be configured to obtain one or more such audio enhancement parameters during a boot sequence (i.e. a first use boot sequence), and to implement a firmware update, program and AES, etc. during the boot sequence.

The acoustic test chamber may be an anechoic chamber, an acoustically quiet chamber, a chamber with reduced echo, a semi-anechoic chamber, or the like.

According to yet another aspect there is provided use of a tuning rig in accordance with the present disclosure as part of a process for manufacturing a consumer electronic device in accordance with the present disclosure.

According to another aspect there is provided, a consumer electronic device including a casing, the casing defining an enclosure, and an integrated loudspeaker assembly placed within the enclosure. The integrated loudspeaker assembly includes a speaker unit (e.g. a driver, a piezoelectric actuator, an electromagnetic shaker, etc.) and a mounting support. The mounting support is configured to intimately attach the speaker unit to the casing so as to transfer vibration of the speaker unit to the casing. The enclosure contributes a back volume for the speaker unit.

The consumer electronic device may include an audio enhancement system (AES) in accordance with the present disclosure, configured to accept an input signal from a source located within the consumer electronic device and to communicate an output signal to the speaker unit. The audio enhancement system (AES) may be configured to compensate for the back volume and/or an acoustic property of the casing and/or the CED in the output signal.

In aspects, the casing may be substantially sealed (e.g. without acoustically substantial perforations, hermetically sealed, etc.).

According to another aspect there is provided a method for enhancing the audio performance of a consumer electronic device including measuring at least a portion of an acoustic signature of the consumer electronic device, comparing the portion of the acoustic signature of the consumer electronic device to a master design record to quantify a deviation dataset defining the variation between the device and the master design record, producing one or more reconfigured compensation parameters based on the deviation dataset, and programming the reconfigured compensation parameters onto the consumer electronic device.

The method may include placing the consumer electronic device into an audio test chamber, as well as sending the acoustic signature, and/or the reconfigured compensation parameters to a cloud based data center.

In aspects, the method may include programming the consumer electronic device with the reconfigured compensation parameters on first boot thereof (i.e. when first turned on by a customer, in a sales office, etc.).

DETAILED DESCRIPTION

Figure 1:
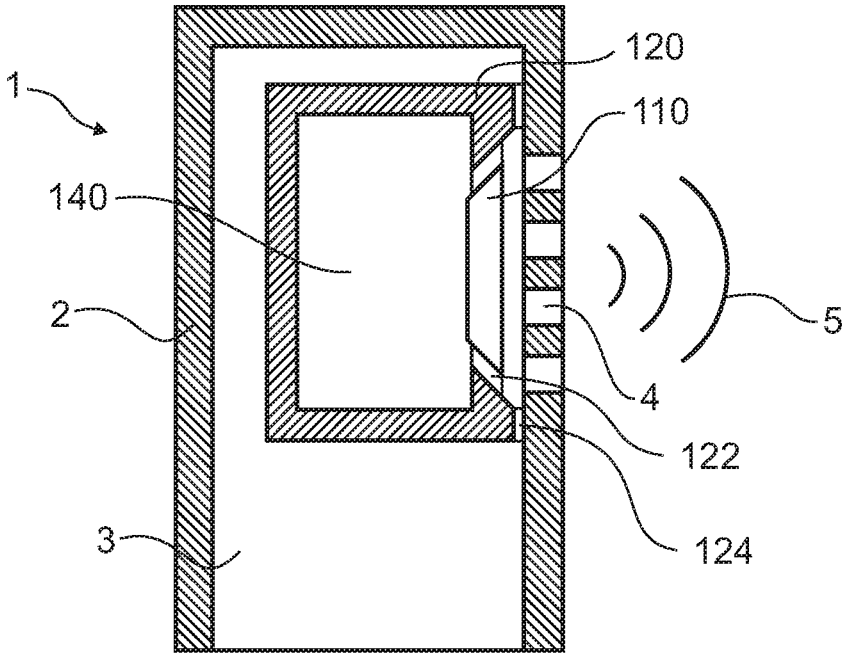
Fig 1 (PRIOR ART)
FIG. 1 shows an example of a conventional loudspeaker assembly in a consumer electronic device.

Particular embodiments of the present disclosure are described hereinbelow with reference to the accompanying drawings; however, the disclosed embodiments are merely examples of the disclosure and may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in virtually any appropriately detailed structure. Like reference numerals may refer to similar or identical elements throughout the description of the figures.

By consumer electronic device is meant a cellular phone (e.g. a smartphone), a tablet computer, a laptop computer, a portable media player, a television, a portable gaming device, a gaming console, a gaming controller, a remote control, an appliance (e.g. a toaster, a refrigerator, a bread maker, a microwave, a vacuum cleaner, etc.) a power tool (a drill, a blender, etc.), a robot (e.g. an autonomous cleaning robot, a care giving robot, etc.), a toy (e.g. a doll, a figurine, a construction set, a tractor, etc.), a home entertainment system, etc.

Figure 2:
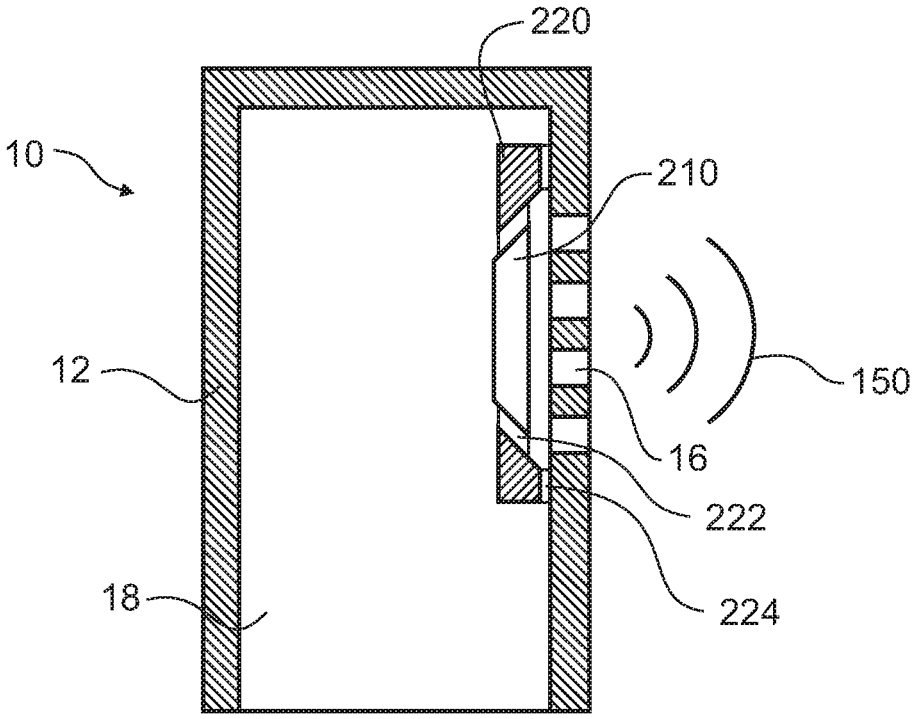
FIG. 2 shows an integrated loudspeaker assembly in a consumer electronic device in accordance with the present disclosure.

FIG. 2 shows an integrated loudspeaker assembly in a consumer electronic device (CED) 10 in accordance with the present disclosure. The CED 10 includes a casing 12 and a plurality of perforations 16 (or equivalent thereof) in the casing 12, for providing fluid communication between the inside of the CED 10 and a surrounding environment. The loudspeaker assembly includes a speaker unit 210 and mounting support 220. The speaker unit 210 may be attached to the mounting support 220 with a flexible support 222. The mounting support 220 may be attachable to the casing using a mounting adhesive 224 or equivalent means of attachment (e.g. welding, glue bonding, screws, rivets, mechanical interconnections, etc.). The speaker unit 210 may be configured to operably produce an audio output signal 150.

The casing 12 defines an enclosure 18 into which the components (e.g. electrical components, mechanical components, assemblies, integrated loudspeaker assembly, etc.) may be placed.

The integrated loudspeaker assembly may be placed adjacent to the perforations 16 such that the speaker unit 210 separates the perforations 16 from the rest of the enclosure 18 of the CED 10 (e.g. effectively forming an air-tight seal between the perforations 16 and the rest of the enclosure 18).

The integrated loudspeaker assembly may be provided without a well-defined back volume. Thus the back volume for the speaker unit 210 may be at least partially shared with the rest of the enclosure 18 of the CED 10. Thus the back volume for the speaker unit 210 may not be fully defined until the integrated loudspeaker assembly is fully integrated into the final CED 10 (e.g. along with all the other components that makeup the CED 10). Such a configuration may be advantageous for increasing the available back volume for the speaker unit 210, thus extending the overall bass range capabilities of integrated loudspeaker assembly within the CED 10.

The speaker unit 210 may include a voice coil, a spider, a cone, a dust cap, a frame, and/or one or more pole pieces as known to one skilled in the art.

The mounting support 220 may be formed from a thermoplastic, a metal, an amorphous metal, a composite, combinations thereof, or the like as known to one skilled in the art.

In aspects, the integrated loudspeaker assembly may include electrical interconnects, driver, gasket, filters, audio enhancement chipsets (e.g. to form an active speaker), etc.

In aspects, the integrated loudspeaker assembly may include an audio amplifier (e.g. a class AB, class D amplifier, etc.), a crossover (e.g. a digital cross over, an active cross over, a passive crossover, etc.), and/or an audio enhancement system (AES) in accordance with the present disclosure. The circuitry may be electrically connected to the speaker unit 210 and to one or more electrical interconnects, one or more components within the CED 10 (i.e. a processor, an amplifier, a power converter, etc.), or the like. The AES may be configured to compensate for the back volume formed by the speaker unit 210 and enclosure 18 of the casing 12, acoustic resonances of the casing 12, acoustic contributions of the components and interconnection of components placed into the CED 10, and the like.

Figure 3:
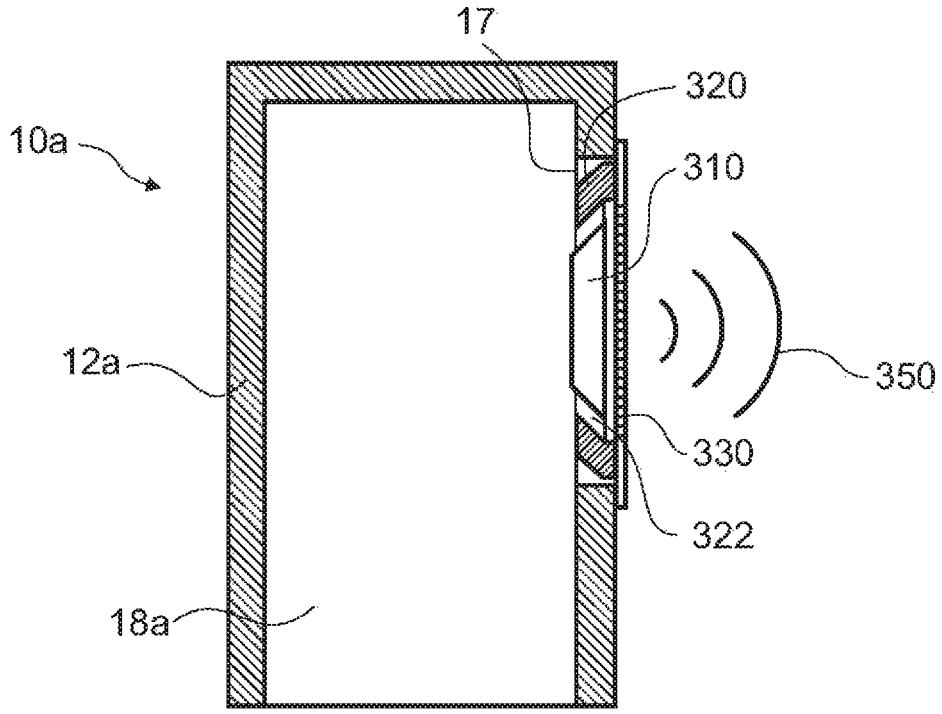
FIG. 3 shows aspects of an integrated loudspeaker assembly embedded into the casing of a consumer electronic device in accordance with the present disclosure.

FIG. 3 shows an integrated loudspeaker assembly embedded into the casing 12*a* of a consumer electronic device 10*a* in accordance with the present disclosure. The casing 12*a* may include an aperture 17 into which the integrated loudspeaker assembly may be placed. The integrated loudspeaker assembly may include a speaker unit 310, a mounting support 320, a flexible support 322, and a perforated mounting plate 330 (e.g. a plate with holes placed there through so as to provide fluid communication on either side of the plate). The speaker unit 310 may be connected to the mounting support 320 directly or via the flexible support 322. The casing 12*a* may define an enclosure 18*e* into which the components (e.g. electrical components, mechanical components, assemblies, integrated loudspeaker assembly, etc.) may be at least partially placed.

The integrated loudspeaker assembly may include one or more gaskets and/or adhesive mounts to form an airtight separation between the mounting support 320, the sides of the speaker unit 310, the perforated mounting plate 330, and/or the casing 12*a*.

Such a configuration may be advantageous for substantially minimizing the space within the CED 10*a* consumed by the integrated loudspeaker assembly, while substantially maximizing the enclosure 18*a* space available for use as the back volume for the speaker unit 310 or for additional components of the CED 10*a*. Thus such a configuration may be advantageous for improving one or more aspects (e.g. dynamic range, bandwidth, available sound pressure level, etc.) of the audio output signal 350 operably available from the CED 10*a*.

The perforated mounting plate 330 may be part of a filter unit, a porous frame element, a design feature, or the like. The perforated mounting plate 330 may be constructed from a plastic sheet, a metal (e.g. a high strength steel sheet, an aluminum sheet, a titanium sheet, etc.), a composite, an amorphous metal component, a film, combinations thereof, or the like. The perforated mounting plate 330 may alternatively or additionally include a composite of a first material (e.g. a high strength steel, titanium, etc.) and a thin filter (e.g. a flexible mesh, a fabric cover, a nonwoven porous structure, etc.). Such a configuration may be advantageous to maintain high strength of the unit while decreasing the cost of manufacture, or achieving the desired design feature for the component.

In aspects, the perforated mounting plate 330 and/or the casing 12*b* may include an acoustic metamaterial. Such a configuration may be advantageous for directing sound produced by the speaker unit 310 by design based, or electrically controlled manipulation of the refractive index thereof. Such a configuration maybe advantageous for directing an ultrasonic signal produced by the speaker unit 310, for generating an acoustical cloaking signal, etc.

In aspects, the perforated mounting plate 330 may be flat, curved, contoured to the casing 12*a*, etc. The perforated mounting plate 330 may include flange elements or equivalent features for fastening the perforated mounting plate 330 to the casing 12*a*.

The loudspeaker assembly may include electrical interconnects, driver, gasket, filters, audio enhancement chipsets (e.g. to form an active speaker), etc.

In one non-limiting example, the loudspeaker assembly may include an audio amplifier (e.g. a class AB, class D amplifier, etc.), a crossover (e.g. a digital cross over, an active cross over, a passive crossover, etc.), and/or an audio enhancement system (AES) in accordance with the present disclosure. The AES may be configured to compensate for the back volume formed by the speaker unit 310 and enclosure 18*a* of the casing 12*a*, acoustic resonances of the casing 12*a*, acoustic properties of the integrated loudspeaker assembly (e.g. properties of the speaker unit 310, the perforated mounting plate 330, the mounting support 320, the flexible support 322, etc.), acoustic contributions of the components and interconnection of components placed into the CED 10*a*, manufacturing process variations, and the like.

Figure 4:
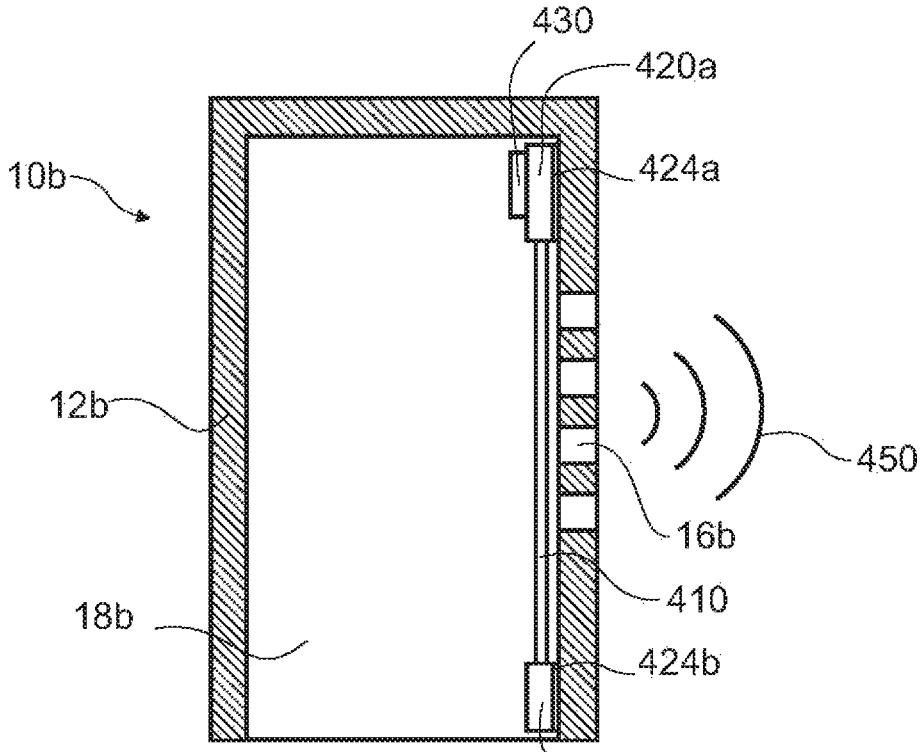
FIG. 4 shows aspects of an integrated loudspeaker assembly including a membrane speaker in accordance with the present disclosure.

FIG. 4 shows an integrated loudspeaker assembly including a film speaker 410 in accordance with the present disclosure. The integrated loudspeaker assembly is shown attached to an inner wall of a casing 12 of a consumer electronic device (CED) 10 (i.e. laminated, adhesively coupled thereto, bonded, ultrasonically bonded, thermally bonded thereto, etc.). The integrated loudspeaker assembly may include a film speaker 410, one or more mounting supports 420*a,b*, and a driver, power converter, and/or audio processor (e.g. an audio enhancement system in accordance with the present disclosure), collectively shown as an integrated electronic component 430. The film speaker 410 may be attached to the mounting supports 420*a,b*. The mounting supports 420*a,b* may be attached to the casing 12*b* by mounting adhesives 424*a,b* or an equivalent thereof (e.g. a glue, welding, mechanical interlocks, etc.). The casing 12*b* defines an enclosure 18*b* into which the components (e.g. electrical components, mechanical components, assemblies, integrated loudspeaker assembly, etc.) may be at least partially placed. In aspects, the casing 12*b* may include one or more perforations 16*b* there through so as to provide fluid communication across the casing 12*b*. The integrated loudspeaker assembly may be placed adjacent to the perforations 16*b* such that the speaker unit 410 separates the perforations 16*b* from the rest of the enclosure 18*b* of the CED 10*b* (e.g. effectively forming an air-tight seal between the perforations 16*b* and the rest of the enclosure 18*b*).

The mounting supports 420*a,b* may be formed from a polymer, a metal, a ceramic, a composite, an amorphous metal, a combination thereof, or the like. The mounting supports 420*a,b* may also house the driver and/or audio processor 430. In one non-limiting example, the audio processor 430 and associated driver may be provided as hardware units, and encapsulated into or mounted onto the mounting supports 420*a,b*. Such a configuration may be advantageous to further reduce the space occupied within the CED 10*b* by the integrated loudspeaker assembly as well as to provide a simple interface by which other electrical components in the CED 10*b* may interface with the integrated loudspeaker assembly during use.

The film speaker 410 may include a ferroelectric polymer (e.g. a piezoelectric polymer, an electrostrictive polymer, a dielectric elastomeric polymer, a graft elastomer, a high dielectric permittivity thermoplastic elastomer, etc.), an electret, a piezoceramic structure, or the like. In aspects, the film speaker 410 may be generally configured to transform an electrical input signal into a mechanical output (i.e. deformation). Such transduction can be used to generate audio signals from the film speaker 410. In aspects, reverse transduction applied to the film speaker 410 such as a mechanical input (i.e. deformation) may produce an electrical output signal (i.e. a charge separation). Thus the film speaker 410 may be configured to produce a feedback signal for use by one or more components within the CED 10*b*. To provide the ferroelectric polymer element, electret, piezoceramic structure, etc. configured with suitable interconnects, so as to accept an input signal is generally sandwiched between thin electrode elements, which are in turn connected to a signal source, amplifier, sensory circuit, or the like.

Although such a film speaker 410 may produce efficient energy conversion between an electrical input and a mechanical output (thus providing the potential for size and/or cost reduced devices versus traditional electromagnetic speaker technologies), such speakers can be prone to nonlinear transduction effects, memory effects, rate dependent hysteresis, mode breakup, large signal nonlinearities, limited bass response, environmental dependence (e.g. temperature, humidity, pressure differences, etc.), and the like. By coupling a film speaker 410 and an audio enhancement system (AES) in accordance with the present disclosure, and optimally programming the AES, the audio output 450 from the associated CED 10*b* may be significantly improved. Additionally, alternatively, or in combination the film speaker 410 may be coupled to the casing 12*b* with one or more patterned mounting supports 420*a,b*. Such patterned supports may be strategically arranged so as to minimize mode breakup, optimize output from the film speaker, etc.

In aspects, the film speaker 410 may be configured with a plurality of electrodes, the electrodes patterned over the surface of the film speaker 410 so as to enhance and/or minimize mode resonances, to provide in-speaker bass, treble, and mid band separations, etc. Such a configuration may be advantageous for naturally enhancing the audio output from the film speaker 410 without adding additional components, weight, etc. to the consumer electronic device 10*b*.

In aspects, the acoustic aspects of the film speaker 410 may be significantly altered and influenced by the particular configuration of the CED 10*b*, casing 12*b*, portion of the enclosure volume 18*b* available as a back volume, number, placement and/or organization of other components within the CED 10*b*, means of attachment between the integrated loudspeaker assembly and the casing 12*b*, etc. Many of the acoustic aspects of such systems will not be fully characterize able until the system has been completely assembled. Thus an AES in accordance with the present disclosure, in combination with the integrated loudspeaker assembly and the CED 10*b*, many by optimized late in the design, development and/or manufacturing process to compensate for many of these, generally negative, acoustic properties in the fully manufactured device.

The AES may be configured initially during the design stage of the product development, in an audio test facility. Thus an initial set of AES parameters may be assembled and loaded into the AES. During manufacturing of the CED, individual devices, batches, etc. which have differing acoustic properties and anomalies due to manufacturing variances, component changes, material changes, etc. may be conveniently adjusted during the manufacturing process. The tuning of the AES with respect to the particular configuration of an integrated loudspeaker assembly including a film speaker 410 into a CED 10*b*, may be performed with a tuning rig 700 in accordance with the present disclosure.

In one non-limiting example, the AES may include a nonlinear compensation function (e.g. as part of a parametrically configurable processing [PCP] block, etc.). Related to an electrostrictive type film speaker, a square root nonlinear compensation function may be employed as outlined in equation 1:

$$y_n = a_1\sqrt{|x_n|} \qquad \text{[equation 1]}$$

where $x_n$ is the time sampled input to the block, $y_n$ is the time sampled output from the block, and $a_1$ is again parameter. Instead of a true square root function, a less computationally intense approximate function may be employed.

In aspects, utilizing soft material film actuators (e.g. dielectric elastomeric, thermoplastic elastomeric, etc.), large deformations may occur during use, especially at lower operating frequencies. In such cases, a polynomial compensation function may be employed for nonlinear compensation. Such nonlinear compensation may also be a function of operating frequency, operating temperature, humidity, ambient pressure, etc. In aspects, control circuitry for such actuators may include pull-in control elements, or the like.

The loudspeaker assembly may include electrical interconnects, a driver, a gasket, filters, audio enhancement chipsets (e.g. to form an active speaker), etc. Such elements may be added onto/attached to one or more of the shown components and/or integrated into one or more of the components (e.g. integrated into one or more of the mounting supports 420*a,b*).

In one non-limiting example, the loudspeaker assembly may include an audio amplifier (e.g. a charge amplifier, etc.) suitable for driving the film speaker 410, a crossover (e.g. a digital cross over, an active cross over, a passive crossover, etc.), and/or an audio enhancement system (AES) in accordance with the present disclosure (collectively shown as an integrated electronic component 430). The integrated electronic component 430 may be coupled to the film speaker 410 and one or more interconnects within the loudspeaker assembly, to one or more components of the consumer electronic device 10*b*, etc. In aspects, the integrated electronic component 430 may include an AES in accordance with the present disclosure. Additionally, alternatively, or in combination, the consumer electronic device 10*b* may include an AES in accordance with the present disclosure. The AES may be configured to compensate for the back volume formed behind the film speaker 410 within the enclosure 18*b* of the casing 12*b*, acoustic aspects of the film speaker 410, nonlinearities associated with the film speaker 410, acoustic resonances of the casing 12*b*, acoustic properties of the integrated loudspeaker assembly (e.g. acoustic aspects of the film speaker 410, nonlinearities associated with the film speaker 410 and/or the drive electronics, the mounting supports 420*a,b*, the mounting adhesives 424*a,b*, etc.), acoustic contributions of the components and interconnection of components placed into the CED 10*a*, manufacturing process variations, and the like.

Figure 5:
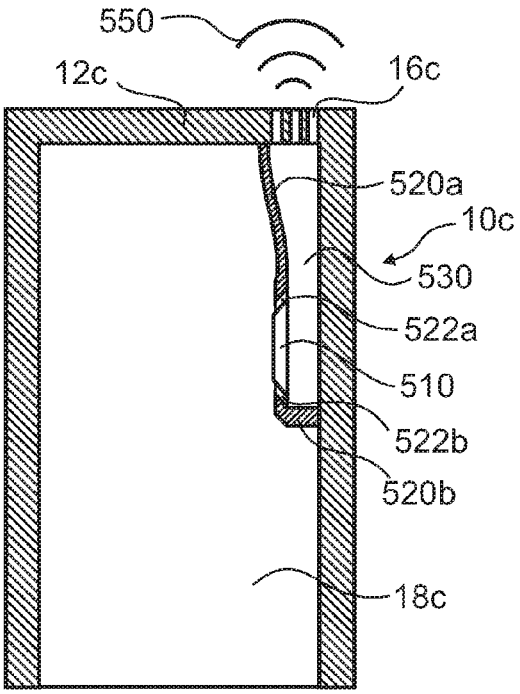
FIG. 5 shows aspects of an integrated loudspeaker assembly including a waveguide in accordance with the present disclosure.

FIG. 5 shows an integrated loudspeaker assembly including mounting supports 520*a,b* and a speaker unit 510 in accordance with the present disclosure. The integrated loudspeaker assembly may be attached to the casing 12*c* of a consumer electronic device (CED) 10*c*. The integrated loudspeaker assembly may include a speaker unit 510 attached to one or more mounting supports 520*a,b* by one or more flexible supports 522*a,b*.

The mounting supports 520*a,b* may be attached to the casing 12*c* so as to form an acoustic waveguide 530. The remaining space within the casing 12*c* may define an enclosure 18*c*. The waveguide 530 may be formed so as to interface with one or more perforations 16*c* through the wall(s) of the casing 12*c*. The waveguide 530 may include one or more walls, a portion of which may be formed by a mounting support 520*a,b* and/or a portion of the casing 12*c*. The integrated loudspeaker assembly may be configured such that at least a portion of the enclosure 18*c* formed by the casing 12*c* may be used to form a back volume for the speaker unit 510. The enclosure 18*c* may include one or more components, each component taking up a portion of the space within the casing 12*c*. The actual space of the enclosure 18*c* available for use as back volume may depend on proportion of space taken up by the components in the CED 10*c*.

In aspects, the loudspeaker assembly may include electrical interconnects, a driver, a gasket, filters, an integrated electronic component, a driver, an amplifier, a power converter, an audio enhancement chipset (e.g. to form an active speaker), etc. Such elements may be added onto, coupled to, and/or integrated into one or more the components (e.g. integrated into one or more of the mounting supports 520*a,b*, the speaker unit 510, etc.).

In one non-limiting example, the loudspeaker assembly may include an integrated electronic component such as an audio amplifier (e.g. a class D amplifier, a class AB amplifier, etc.) suitable for driving the speaker unit 510, a crossover (e.g. a digital cross over, an active cross over, a passive crossover, etc.), and/or an audio enhancement system (AES)

in accordance with the present disclosure to generate an acoustic signal 550 from the speaker unit 510.

The AES may be configured to compensate for the back volume formed behind the speaker unit 510 within the enclosure 18*c* of the casing 12*c*, acoustic aspects of the speaker unit 510, nonlinearities associated with the speaker unit 510, acoustic resonances of the casing 12*c*, acoustic properties of the integrated loudspeaker assembly (e.g. acoustic aspects of the speaker unit 510, the mounting supports 520*a,b*, the structure of the waveguide 530, etc.), acoustic contributions of the components and interconnection of components placed into the CED 10*c*, manufacturing process variations, and the like.

Figure 6:
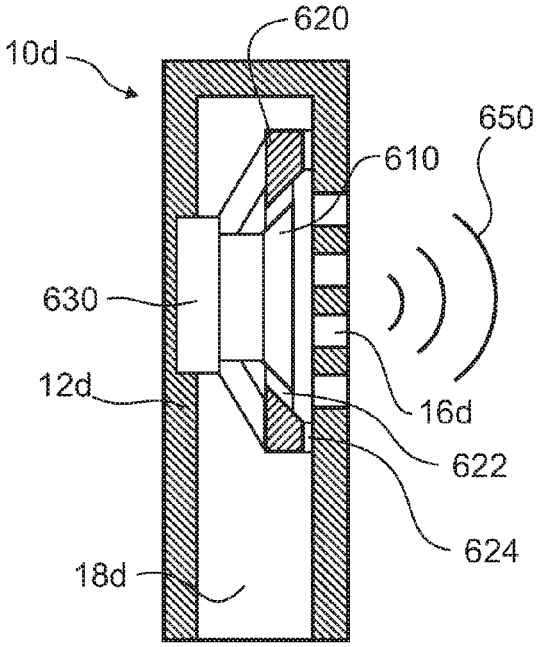
FIG. 6 shows aspects of an integrated loudspeaker assembly in accordance with the present disclosure, suitable for providing structural support to the casing of a consumer electronic device.

FIG. 6 shows an integrated loudspeaker assembly in accordance with the present disclosure, suitable for providing structural support to the casing 12*d* of a consumer electronic device (CED) 10*d*. The integrated loudspeaker assembly may include a speaker unit 610 with an acoustically open magnetic assembly 630, and a mounting support 620. The speaker unit 610 may be attached to the mounting support 620 by a flexible support 622. The integrated loudspeaker assembly may be attached to the casing 12*d* with a mounting adhesive 624 or equivalent means of attachment (e.g. welding, glue bonding, screws, rivets, mechanical interconnections, etc.). The casing 12*d* may include one or more perforations 16*d* for providing fluid communication there through. Attachment may be made in the immediate vicinity of one or more perforations 16*d* in the casing 12*d*, the perforations 16*d* may be used to provide fluid communication between the speaker unit 610 and the surroundings. The speaker unit 610 may operably communicate an acoustic signal 650 at least partially through the perforations. The remaining space within the casing 12*d* may define an enclosure 18*d*. The integrated loudspeaker assembly may be configured and abutted against the casing 12*d* so as to isolate the perforations 16*d* from the rest of the enclosure 18*d*.

The integrated loudspeaker assembly may be secured to another portion of the casing 12*d*, such as an opposing face of the casing 12*d* so as to provide increased structural support for the casing. In one non-limiting example, the magnetic assembly 630 is attached to the opposing face of the casing 12*d* from the perforations 16*d*. In another non-limiting example, the magnetic assembly 630 may protrude through the casing 12*d* so as to jut out from the face of the CED 10*d*. Such a protrusion may be suitable for forming a mounting leg for the CED 10*d* (e.g. such as in the case of a laptop, etc.). In a protruding example, the magnetic assembly 630 may be suitable for transferring vibrations (e.g. as produced within the integrated loudspeaker assembly) to a supporting surface (e.g. such as a table, a desk, etc.). Such a configuration may be advantageous for increasing the amount of surface that is acoustically available to the CED 10*d* (e.g. through recruitment of one or more supporting surfaces). In aspects, the magnetic assembly 630 may be coupled to the casing 12*d* via one or more soft mounting features (not explicitly shown), such as an elastomeric coupling, a grommet, a boot, etc.

The integrated loudspeaker assembly may be considerably open so as to acoustically communicate with at least a portion of the enclosure 18*d* of the CED 10*d*. Thus, the integrated loudspeaker assembly may be configured such that at least a portion of the enclosure 18*d* formed by the casing 12*d* may be used to form a back volume for the speaker unit 610. The enclosure 18*d* may include one or more components, each component taking up a portion the space within the casing 12*d*. The actual space of the enclosure 18*d* available for use as back volume may depend on proportion of space taken up by the components in the CED 10*d*.

In one non-limiting example, the loudspeaker assembly may include an integrated electronic component such as an audio amplifier (e.g. a class D amplifier, a class AB amplifier, etc.) suitable for driving the speaker unit 610, a crossover (e.g. a digital cross over, an active cross over, a passive crossover, etc.), and/or an audio enhancement system (AES) in accordance with the present disclosure to generate the acoustic signal 650 (i.e. via the speaker unit 610).

In aspects, the AES may be configured to compensate for the back volume formed behind the speaker unit 610 within the enclosure 18*d* of the casing 12*d*, acoustic aspects of the speaker unit 610, nonlinearities associated with the speaker unit 610, acoustic resonances of the casing 12*d*, acoustic properties of the integrated loudspeaker assembly (e.g. acoustic aspects of the speaker unit 610, the mounting supports 620*a,b*, acoustic properties of the magnetic assembly 630, recruitment of supporting surfaces, etc.), acoustic contributions of the components and interconnection of components placed into the CED 10*d*, manufacturing process variations, and the like.

Figure 7:
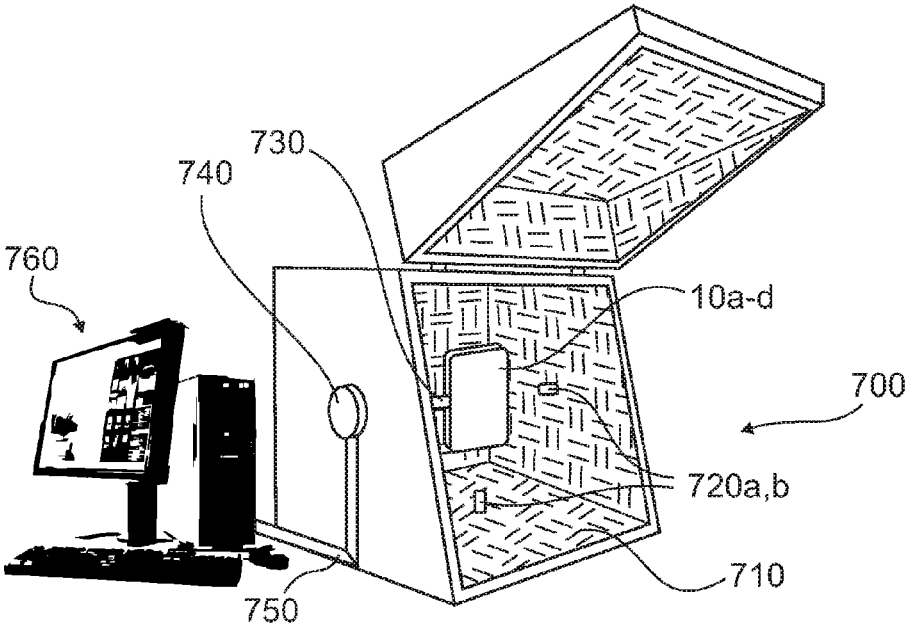
FIG. 7 shows aspects of a system for optimizing the performance of a consumer electronic device in accordance with the present disclosure.

FIG. 7 shows a tuning rig 700 for optimizing the performance of a consumer electronic device 10*a-e* in accordance with the present disclosure. The tuning rig 700 may include an acoustic test chamber 710 or alternatively chamber with an improved acoustic quality (e.g. reduced echo, reduced influence from external sound sources, etc. compared to a manufacturing environment) in which to place a CED 10*a-e* for testing.

The tuning rig 700 may include one or more microphones 720*a,b* spaced within the acoustic test chamber 710 so as to operably obtain acoustic signals emitted from the CED 10*a-e* during a testing and optimization procedure. The tuning rig 700 may also include a boom 730 for supporting the CED 10*a-e*. The boom 730 may also include a connector for communicating with the CED 10*a-e* during a testing and optimization procedure (e.g. so as to send audio data streams to the CED 10*a-e* for testing, to program audio parameters on the CED 10*a-e*, etc.). The boom 730 may be connected to a mounting arm 740 on the wall of the acoustic test chamber 710. The mounting arm 740 may include a rotary mechanism for rotating the CED 10*a-e* about the boom axis during a testing and optimization procedure. The mounting arm 740 may be electrically interconnected with a workstation 760 such as via cabling 750.

The workstation 760 is shown in the form of a computer workstation. Alternatively or in combination, the workstation 760 may include or be a customized hardware system. The hardware configuration of the workstation 760 may include a data collection front end, a hardware analysis block and a programmer. Such a configuration may be advantageous for rapid, autonomous optimization of audio output from the CED 10*a-e* during manufacturing.

The workstation 760 may have support for user input, for example to observe the programming processes, the differences between batch programming results and the design specification, etc. Alternatively or in combination, the workstation 760 may communicate audio test data and/or programming results to a cloud based data center. The cloud based data center may accept audio test data, compare with prior programming histories and/or the master design record/specification, and generate audio programming information to be sent to the CED 10*a-e*.

The workstation 760, or cloud data center equivalent, may include algorithms to compare histories of manufactured CEDs 10*a-e* and trends in the datasets obtained therefrom suitable to predict the performance criteria for the present batch of manufactured consumer electronic devices based on the testing and optimization results of a tested CED 10*a-e*. Such a configuration may be advantageous for economically optimizing the audio performance of a batch of consumer electronic devices during the manufacturing process without having to test and optimize every unit that is manufactured.

In one non-limiting example, the audio processing information for the CED 10*a-e* may be saved within the cloud in the form of a device profile. In one non-limiting usage example, an audio streaming service may use the device profile to pre-process an audio stream before sending the audio stream to the CED 10*a-e*. Such a configuration may be advantageous for improving audio output from the CED 10*a-e* while simultaneously minimizing the power consumed on the CED 10*a-e* during use.

In aspects, such audio processing information for the CED 10*a-e*, parameters, or control elements obtained therefrom, may be retrieved from the cloud during first boot of the CED 10*a-e* (i.e. by a customer, a salesperson, etc.)

In aspects, the workstation 760 may communicate relevant audio streaming and programming data to/from the CED 10*a-e* wirelessly before, during, and/or after a test procedure.

In aspects, the tuning rig 700 may be provided in a retail store or repair center to optimize the audio performance of a CED 10*a-e*, 910 including an audio enhancement system and/or an integrated loudspeaker assembly in accordance with the present disclosure. In one non-limiting example of a fee for service implementation, a tuning rig 700 may be used in a retail store in order to optimize the audio performance of a customer's consumer electronic device, perhaps after selection of a new case for their CED, at the time of purchase, etc. Such systems may provide the discerning consumer with the option to upgrade the audio performance of their device and a retail center to offer a unique experience enhancing service for their consumers.

In aspects, the CED 10*a-e*, 910 may include one or more audio sampling components (e.g. microphones, speakers with dual I/O functionality, etc.). The audio sampling component may be used as a form of feedback for assessing the audio performance of the CED 10*a-e*, 910 in the field (i.e. in practice). In one non-limiting example, the audio enhancement system includes one or more reconfigurable parameters, which may be mildly adjusted in the field to compensate for various slight acoustic property changes due to aging, dust buildup, etc. that may occur throughout the lifetime of the device. In aspects, such small changes may be implemented in a relatively safe fashion (i.e. without introducing instabilities) by using a combination of acoustic output from the system, audio capture from the audio sampling components, and implementation of a correction algorithm (e.g. on the device, in a cloud data center, etc.).

Figure 8:
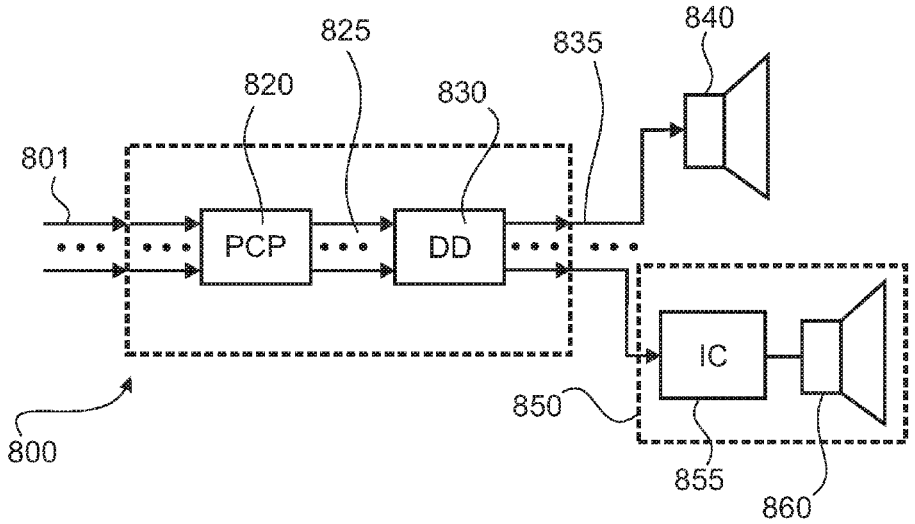
FIG. 8 shows aspects of an audio enhancement system in accordance with the present disclosure.

FIG. 8 shows a schematic of an audio enhancement system 800 in accordance with the present disclosure. The audio enhancement system 800 may be configured to accept one or more input audio signals 801 from a source (e.g. a processor, an audio streaming device, an audio feedback device, a wireless transceiver, an ADC, an audio decoder circuit, a DSP, etc.), and to provide one or more output signals 835 to one or more transducers 840 (e.g. a loudspeaker, etc.), or transducer modules 850 (e.g. a transducer 860 combined with associated integrated circuits 855, etc.). The audio enhancement system 800 may include internal blocks (e.g. parametrically configurable processing [PCP] block, digital driver [DD] block, asynchronous sample rate converter [ASRC] block, etc.) which may be configured to transform and/or act upon the input audio signal 801 or signals derived therefrom to produce and/or contribute aspects to the output signal(s) 835.

The audio enhancement system 800 may be embedded in an application specific integrated circuit (ASIC) or be provided as a hardware descriptive language block (e.g. VHDL, Verilog, etc.) for integration into a system on chip integrated circuit (ASIC), a field programmable gate array (FPGA), or a digital signal processor (DSP) integrated circuit. One or more blocks (e.g. PCP block, ASRC block, etc.) may also be implemented in software on the consumer electronic device and/or in an associated network (e.g. a local network server, in the cloud, etc.). The AES 800 may be an all-digital hardware implementation. An all-digital implementation may be advantageous to reduce the hardware footprint, reduce power consumption, reduce production costs, and increase the number of integrated circuit processes into which the system may be implemented. The implementation may be integrated into a consumer electronic device in order to provide a complete audio enhancement solution.

As shown in FIG. 8, the audio enhancement system 800 for use in a consumer electronic device 10*a-e*, 910 may include a parametrically configurable processing (PCP) block 820 and a digital driver (DD) block 830. The audio enhancement system 800 accepts one or more audio input signals 801 from an audio source. In the schematic shown, the PCP block 820 accepts the input signal 801 and produces an enhanced signal 825. The enhanced signal 825 is provided to the DD block 830 which converts the enhanced signal 825 into one or more output signals 835, suitable for driving a transducer 840 (e.g. a loudspeaker, a speaker unit, an integrated loudspeaker assembly in accordance with the present disclosure, etc.) or a transducer module 850 (i.e. which may be included in an integrated loudspeaker assembly in accordance with the present disclosure).

The PCP block 820 may be configured to provide such functions as FIR filtering, IIR filtering, warped FIR filtering, transducer artifact removal, disturbance rejection, user specific acoustic enhancements, user safety functions, emotive algorithms, psychoacoustic enhancement, signal shaping, single or multi-band compression, expanders or limiters, watermark superposition, spectral contrast enhancement, spectral widening, frequency masking, quantization noise removal, power supply rejection, crossovers, equalization, amplification, driver range extenders, power optimization, linear or non-linear feedback or feed-forward control systems, and the like. The PCP block 820 may include one or more of the above functions, either independently or in combination. One or more of the included functions may be configured to depend on one or more pre-configurable and/or reconfigurable parameters.

The PCP block 820 may be configured to provide echo cancellation, environmental artifact correction, reverb reduction, beam forming, auto calibration, stereo widening, virtual surround sound, virtual center speaker, virtual subwoofer (by digital bass enhancement techniques), noise suppression, sound effects, or the like. One or more of the included functions may be configured to depend on one or more of the parameters.

The PCP block 820 may be configured to impose ambient sound effects onto an audio signal 801, such as by transforming the audio input signal 801 with an ambient environmental characteristic (e.g. adjusting reverb, echo, etc.) and/or superimposing ambient sound effects onto the audio input signal 801 akin to an environmental setting (e.g. a live event, an outdoor setting, a concert hall, a church, a club, a jungle, a shopping mall, a conference setting, an elevator, a conflict zone, an airplane cockpit, a department store radio network, etc.).

The ambient sound effects may include specific information about a user, such as name, preferences, etc. The ambient sound effects may be used to securely superimpose personalized information (e.g. greetings, product specific information, directions, watermarks, handshakes, etc.) into an audio stream.

The DD block 830 may include a pulse width modulator (PWM). The DD block 830 may be pre-configured and/or pre-selected to drive a range of electroacoustic transducers (e.g. electromagnetic, thermoacoustic, electrostatic, magnetostrictive, ribbon, arrays, electroactive material transducers, etc.). The DD block 830 may be configured to provide a power efficient PWM signal to the transducer 840 or the input of a transducer module 850 (e.g. a passive filter circuit, an amplifier, a de-multiplexer, a switch array, a charge accumulator circuit, etc.). Alternatively, additionally, or in combination, the DD block 830 may be configured to communicate with an audio communication module (e.g. serial communication link, parallel communication link, FIFO communication link, I2S, etc.).

In aspects, a block in the AES 800 (or the system itself) may include pre-configurable and/or reconfigurable parameters suitable for configuring the audio processing aspects of the AES 800 (e.g. signal conversion aspects, signal processing aspects, system property compensation, etc.). In aspects, the parameters may be integrated into the AES in general 800, for use by any block 820, 830 within the AES 800. Alternatively or in combination, one or more parameters may be located externally to the AES 800, and the AES 800 may be configured to accept one or more of the external parameters for use by any block 820, 830 within the AES 800.

The pre-configurable and/or reconfigurable parameters may be pre-configured during the design, validation, and/or testing process of the consumer electronic device 10*a-e*, 910. Alternatively, additionally, or in combination, the parameters may be pre-configured, tweaked and/or optimized during the manufacturing, quality control, and/or testing processes of the consumer electronic device 10*a-e*, 910 (e.g. with a tuning rig 700 in accordance with the present disclosure, in an audio test facility, in simulation, etc.). Alternatively, additionally, or in combination, the parameters may be uploaded to the consumer electronic device 10*a-e*, 910 during a firmware upgrade or through a software updating process, as part of a first boot sequence, or the like.

The parameters may be dependent on the particular design of the consumer electronic device 10*a-e*, 910 into which the AES 800 may be integrated and/or to which the AES 800 may be interfaced. The parameters may be dependent on the quality of audio drivers, properties of an associated integrated loudspeaker assembly in accordance with the present disclosure, the back volume formed within the enclosure 18*a-e* of the CED 10*a-e*, component layout, loudspeakers, material and assembly considerations, the casing 12*a-e* of the consumer electronic device 10*a-e*, 910, etc. for a specific consumer electronic device, brand of device, or product family of devices (e.g. a laptop product family, a mobile phone series). The parameters may also depend implicitly on other design factors such as cost, visual appeal, form factor, screen real-estate, case material selection, hardware layout, signal types, communication standards, and assembly considerations amongst others of the consumer electronic device 10*a-e*, 910.

The parameters may be incorporated into the audio enhancement system 800 to create an enhanced audio experience on the associated consumer electronic device 10*a-e*, 910. Alternatively, the parameters may be used to optimize the AES 800 essentially being intimately integrated into the AES 800 architecture to provide the enhanced audio experience from the CED 10*a-e*, 910.

Figure 9A:
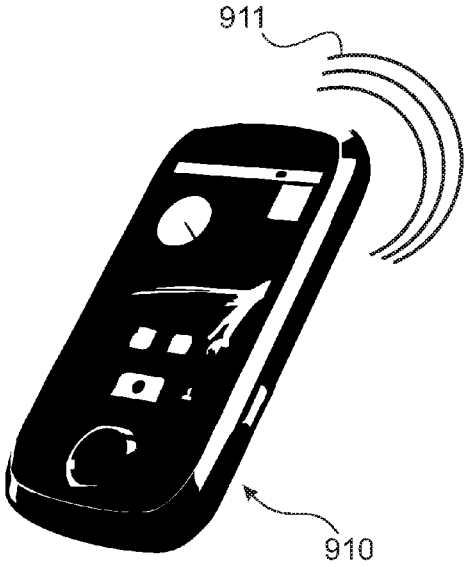
FIGS. 9*a-b* show aspects of a consumer electronic device and audio spectral response obtained therefrom.
Figure 9B:
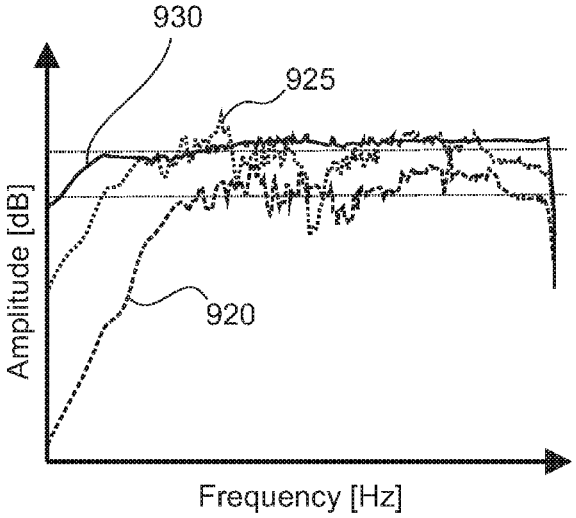

FIGS. 9*a-b* show a consumer electronic device 910 and audio spectral response obtained therefrom. The consumer electronic device 910 (e.g. a smartphone) is configured to produce an audio output signal 911. The CED 910 may include an integrated loudspeaker assembly and an AES 800 both in accordance with the present disclosure. The CED 910 may be tested to determine an associated acoustic signature during the design process, the manufacturing process, the validation process, or the like, and the audio performance thereof adjusted through programming of the AES included therein.

FIG. 9*b* shows a comparison between a frequency response test of the audio output 911 of the consumer electronic device 910 including a conventional loudspeaker assembly (trace 920), with an integrated loudspeaker assembly in accordance with the present disclosure (trace 925), and with both an integrated loudspeaker assembly and an associated and optimized audio enhancement system both in accordance with the present disclosure (trace 930). The figure shows a log-linear frequency response plot with frequency along the horizontal axis and amplitude of the audio output 911 along the vertical axis, in units of decibels.

The trace 925 shows the frequency response of the consumer electronic device 910 with an integrated loudspeaker assembly in accordance with the present disclosure. Comparing trace 920 with trace 925, the integrated loudspeaker assembly leads to an extended bass response compared with a conventional loudspeaker assembly. The introduction of the integrated loudspeaker assembly may introduce new artifacts, resonances, etc. which are also visible in the figure.

The trace 930 shows the frequency response of the consumer electronic device 910 with an integrated loudspeaker assembly and an audio enhancement system both in accordance with the present disclosure. As seen from the figure, when tuned to the final properties of the CED 910, the audio enhancement system 800 levels out the frequency response, while further extending the bass range (e.g. lower frequency range) of the frequency response versus either responses shown in either of the other traces (e.g. compared to trace 920 and trace 925).

These improvements in the audio output 911 from the consumer electronic device 910 may be advantageous for improving user experience, decreasing part to part variability, and for standardizing audio applications that run on the consumer electronic device 910.

By using a tuning rig 700 in accordance with the present disclosure, to analyze the frequency response, impulse response, etc. of the consumer electronic device 910 an accurate and compensate able calculation of an acoustic signature for the consumer electronic device 910 may be made. Optimal compensating parameters for an associated audio enhancement system 800 can be derived from the acoustic signature. The acoustic signature can then be compensated for in the audio enhancement system 800 to produce an enhanced audio output 911 from the CED 910. The acoustic signature may also be used to derive one or more parameters in the audio enhancement system 800 thus providing another means for compensating for the acoustic signature of the consumer electronic device 910.

Figure 10A:
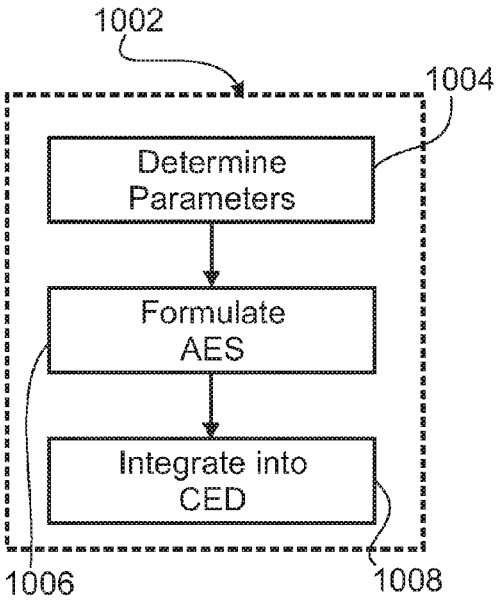
FIGS. 10*a-b* show methods for optimizing audio performance of a consumer electronic device including an integrated loudspeaker system and an audio enhancement system in accordance with the present disclosure for use during a design phase and a manufacturing phase of the consumer electronic device.
Figure 10B:
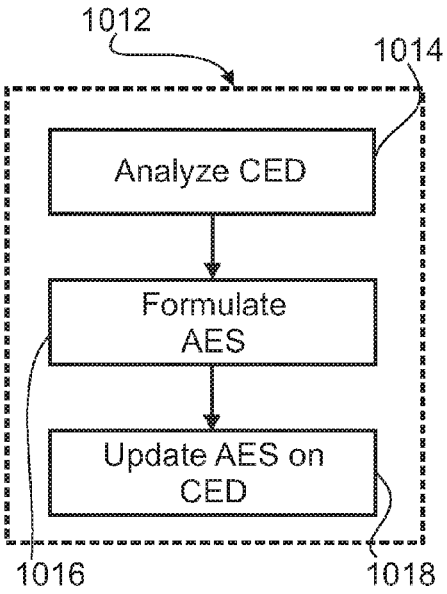

FIGS. 10*a-b* show methods for optimizing audio performance of a consumer electronic device including an integrated loudspeaker system and an audio enhancement system in accordance with the present disclosure for use during a design phase and a manufacturing phase of the consumer electronic device.

FIG. 10*a* shows a method 1002 for enhancing audio performance of a consumer electronic device including an integrated loudspeaker assembly and an audio enhancement system in accordance with the present disclosure. The method 1002 includes determining a set of parameters 1004 for a configurable audio processing system (e.g. an audio enhancement system), optimizing and/or formulating the audio processing system with the parameters 1006, and integrating the optimized audio processing system into the consumer electronic device 1008.

The parameters may be determined and/or optimized by analyzing the consumer electronic device in an acoustic test chamber (e.g. an anechoic test chamber, a semi-anechoic test chamber, a tuning rig 700 in accordance with the present disclosure, etc.) including one or more audio sensors, and running a configuration algorithm to pre-configure and determine the optimal parameters for the configurable audio processing system in combination with the analysis. The parameters may be iteratively determined through repetition of the analysis process.

A non-limiting example of a method for enhancing audio performance of a consumer electronic device (CED) 10*a-e*, 910 includes placing the consumer electronic device 10*a-e*, 910 including an audio signal source, one or more transducers, an integrated loudspeaker assembly, and an audio enhancement system (AES) into an acoustic test chamber with a plurality of audio sensors (e.g. microphones) spatially and optionally strategically arranged within the acoustic test chamber and/or on or within the CED 10*a-e*, 910 (e.g. a microphone on a handset CED 910). A range of test audio signals (e.g. impulse signals, frequency sweeps, music clips, pseudo-random data streams, etc.) may be played on the consumer electronic device 910, monitored and recorded with the audio sensors. In an initial test, the audio enhancement system 800 may substantially include an uncompensated distortion function (a null state whereby the audio enhancement system 800 is configured so as to not substantially affect the audio signal pathway through the CED 10*a-e*, 910). The uncompensated distortion function may act to minimally affect the acoustic signature of the CED 10*a-e*, 910 during the initial testing procedures.

The effect of the CED 10*a-e*, 910 on the test audio signals can be measured by the audio sensors. An acoustic signature for the CED 10*a-e*, 910 can be estimated from cross correlation of the test audio signals with the corresponding measured signals from the audio sensors. To further improve the estimation process, the acoustic signature of every element in the acoustic test chamber may be estimated (including any audio sensors, the mounting apparatus of the consumer electronic device, the effect of any test leads or cables on the consumer electronic device, etc.) and subsequently compensated for in the above analysis. Thus a more true representation of the acoustic signature as well as the acoustic responses of the CED 10*a-e*, 910 to the full gamut of test audio signals may be obtained.

In a non-limiting example, the AES 800 may be preconfigured with audio parameters obtained from a master design record in accordance with the present disclosure. The audio response of the CED with the preloaded AES 800 may be tested to determine an acoustic response thereof. The acoustic response may be compared with that of an ideal response as stored in the master design record to quantitatively define variances therefrom. From the variances, an alternative audio response may be generated and tested against stored audio records within the master design record. Thus an alternative audio parameter set may be generated and uploaded to the AES 800 of the CED 10*a-e*, 910.

The audio enhancement system 800 transfer functions may then be parametrically configured to compensate for the acoustic signature of the CED 10*a-e*. 910. One, non-limiting approach for calculating the audio enhancement system transfer function(s) from the acoustic signature of the CED 10*a-e*, 910 is to implement a time domain inverse finite impulse response (FIR) filter based upon the estimated acoustic signature of the CED 10*a-e*, 910. This may be implemented by performing one or more convolutions of the AES 800 transfer functions with the acoustic responses of the CED 10*a-e*, 910 to the audio input signals. An averaging algorithm may be used to optimize the transfer function(s) of the AES 800 from the outputs measured across multiple sources and/or multiple test audio signals.

In one non-limiting example, the compensation transfer function may be calculated from a least squares (LS) time-domain filter design approach. If c(n) is the system response to be corrected (such as the output of an impulse response test) and a compensating filter is denoted as h(n), then one can construct C, the convolution matrix of c(n), as outlined in equation 2:

$$C = \begin{bmatrix} c(0) & & 0 \\ \vdots & \ddots & \vdots \\ c(N_c - 1) & \ddots & c(0) \\ \vdots & \ddots & \vdots \\ 0 & & c(N_c - 1) \end{bmatrix} \quad \text{[equation 2]}$$

where $N_c$ is the length of the response c(n). C has a number of columns equal to the length of h(n) with which the response is being convoluted. Assuming the sequence h has length denoted by $N_h$ then the number of rows of C is equal to $(N_h+N_c-1)$. Then, using a deterministic least squares (LS) approach to compare against a desired response, (in a non-limiting example, defined as the Kronecker delta function $\delta(n-m)$), one can express the LS optimal inverse filter as outlined in equation 3:

$$h(n)=(C^TC)^{-1}C^Ta_m \quad \text{[equation 3]}$$

where $a_m(n)$ is a column vector of zeroes with 1 in the mth position to create the modeling delay. The compensation filter h(n) can then be computed from equation 3 using a range of computational methods.

In another non-limiting example, the parametrically configurable transfer function(s) of the AES 800 may be iteratively determined by subsequently running test audio signals on the CED 10*a-e*, 910 with the updated transfer function(s) and monitoring the modified acoustic signature of the CED 10*a-e*, 910 with the audio sensors. A least squares optimization algorithm may be implemented to iteratively update the transfer function(s) between test regiments until an optimal modified acoustic signature of the CED 10*a-e*, 910 is obtained. In this way, a set of pseudo-optimal transfer function(s) may be generated (along with an associated set of audio parameters for upload to the CED 10*a-e*, 910, perhaps via at tuning rig 700 in accordance with the present disclosure).

Other, non-limiting examples of optimization techniques include non-linear least squares, L2 norm, averaged one-dependence estimators (AODE), Kalman filters, Markov models, back propagation artificial neural networks, Baysian networks, basis functions, support vector machines, k-nearest neighbors algorithms, case-based reasoning, decision trees, Gaussian process regression, information fuzzy networks, regression analysis, self-organizing maps, logistic regression, time series models such as autoregression models, moving average models, autoregressive integrated moving average models, classification and regression trees, multivariate adaptive regression splines, and the like.

Due to the spatial nature of the acoustic signature of a CED 10*a-e*, 910 the optimization process may be configured so as to minimize error between an ideal system response and the actual system response as measured at several locations within the sound field of the CED 10*a-e*, 910. The multi-channel data obtained via the audio sensors may be analyzed using sensor fusion approaches. In many practical cases, the usage case of the CED 10*a-e*, 910 may be reasonably well defined (e.g. the location of the user with respect to the device, the placement of the device in an environment, etc.) and thus a suitable spatial weighting scheme can be devised in order to prioritize the audio response of the CED 10*a-e*, 910 in certain regions of the sound field that correspond to the desired usage case. In one, non-limiting example, the acoustic response within the forward facing visual range of a laptop screen may be favored over the acoustic response as measured behind the laptop screen during such tests. In this way, a more optimal acoustic enhancement system 800 may be formulated to suit a particular usage case for the CED 10*a-e*, 910.

FIG. 10*b* shows a non-limiting example of a method 1012 for enhancing audio in a consumer electronic device. The method 1012 includes integrating a configurable audio enhancement system into a consumer electronic device 1014, testing the consumer electronic device during the manufacturing, validation or final testing process 1016, and updating the audio enhancement system within the consumer electronic device 1018.

The consumer electronic device may be tested 1016 in an automated tuning rig 700 in accordance with the present disclosure. The tuning rig 700 may run a diagnostic test on the consumer electronic device 10*a-e*, 910 and record audio output from the device 10*a-e*, 910 obtained during the diagnostic test. An update to the audio enhancement system 800 may be generated using data obtained from the diagnostic test, and the automated test cell may update the audio enhancement system on the consumer electronic device 10*a-e*, 910.

The method 1012 may include hardcoding the optimized audio processing system into a hardware descriptive language (HDL) implementation (e.g. for implementation on an FPGA, etc.). An HDL implementation may be advantageous for simplifying integration of the audio processing and enhancement system into existing processors and/or hardware on the consumer electronic device. An HDL implementation may also be advantageous for encrypting and protecting the parameters in the audio processing system.

Alternatively, additionally, or in combination, the method 1012 may include soft-coding the optimized audio processing system and/or associated parameters into a processor, flash, EEPROM, memory location, or the like. Such a configuration may be used to implement the AES in software, as a hardcoded routine on a DSP, a processor, and ASIC, etc.

Figure 11:
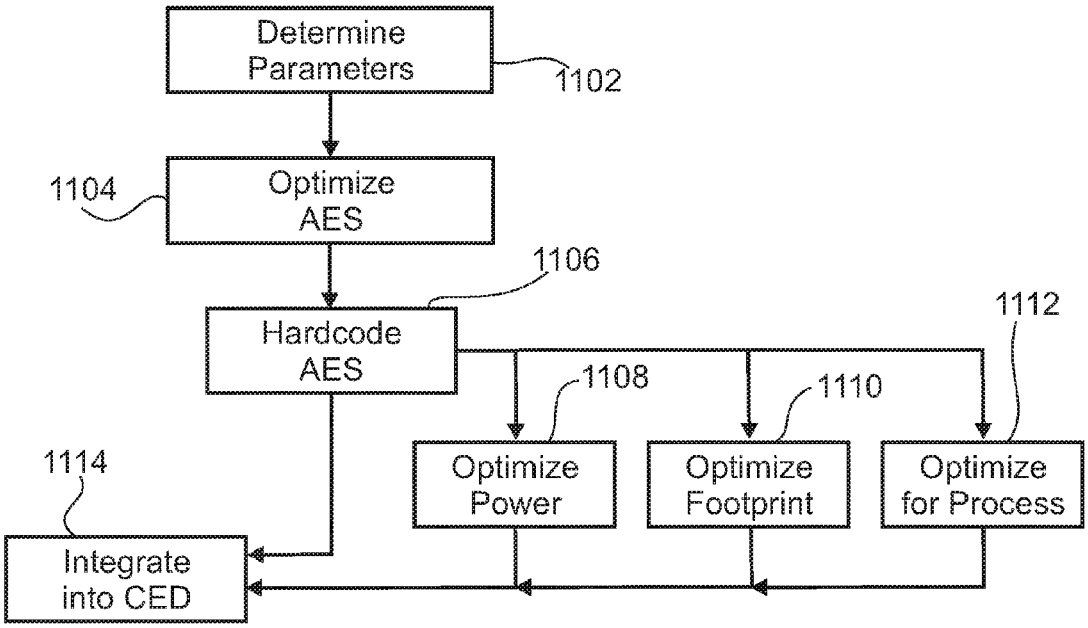
FIG. 11 shows a method for optimizing audio performance of a consumer electronic device including an integrated loudspeaker system and an audio enhancement system in accordance with the present disclosure.

FIG. 11 shows a non-limiting example of a method for integrating an audio enhancement system (AES) and an integrated loudspeaker assembly both in accordance with the present disclosure into a consumer electronic device. The method includes determining one or more parameters for use in the audio enhancement system 1102, optimizing the audio enhancement system 1104, hard coding the audio enhancement system 1106 into a hardware descriptive language (HDL) implementation, and integrating the audio enhancement system into a consumer electronic device 1114. The method may include a step of optimizing the power usage of the AES 1108, optimizing the footprint of the AES 1110, and/or optimizing the hardcoded implementation for a given semiconductor fabrication process 1112.

The step of determining one or more parameters for use in the audio enhancement system 1102 may be first performed during the design stage of the associated consumer electronic device. During this first step, the consumer electronic device with an integrated loudspeaker assembly and audio enhancement system in accordance with the present disclosure, may be tested and analyzed in an audio test facility. The results of the testing may be used to construct an optimal set of parameters for use with the associated AES to compensate for acoustic anomalies and deficiencies in the CED. The AES may be tuned with the parameters and the system may be iteratively tested and corrected as part of the parameter determination process 1102.

The step of optimizing the AES 1104 may be performed and/or updated during the final manufacturing and/or programming steps of the CED. Such a step may be performed using a tuning rig 700 in accordance with the present disclosure.

Robustness of the optimization step 1104 may be improved by incorporating at least a portion of a master design record (e.g. a known good acoustic signature and/or associated AES parameters, developed for the specific CED, optionally during the design stages of the CED and/or throughout the manufacturing history of the CED), into the optimization process. The process may include measuring at least a portion of an acoustic signature of the consumer electronic device, comparing the portion of the acoustic signature of the consumer electronic device to a master design record to quantify a deviation dataset. The deviation dataset may define the variation between the device and the master design record. The method may include the steps of producing one or more reconfigured compensation parameters based on the deviation dataset, and programming the reconfigured compensation parameters onto the consumer electronic device.

A multi-stage optimization process may be advantageous for improving the robustness of the production line optimization step 1012, determining if a faulty measurement or faulty device has been measured (e.g. as determined by the measurements indicating more than a predetermined deviation level from the master design record, etc.), characterizing manufacturing drift of properties over time, as a quality control methodology, to improve manufacturing fault diagnostics, etc.

The method may include optimizing the HDL implementation for reduced power 1108, reduced footprint 1110, or for integration into a particular semiconductor manufacturing process (e.g. 13 nm-0.5 μm CMOS, CMOS-Opto, HV-CMOS, SiGe BiCMOS, etc.) 1112. This may be advantageous for providing an enhanced audio experience for a consumer electronic device without significantly impacting power consumption or adding significant hardware or cost to an already constrained device.

Figure 12:
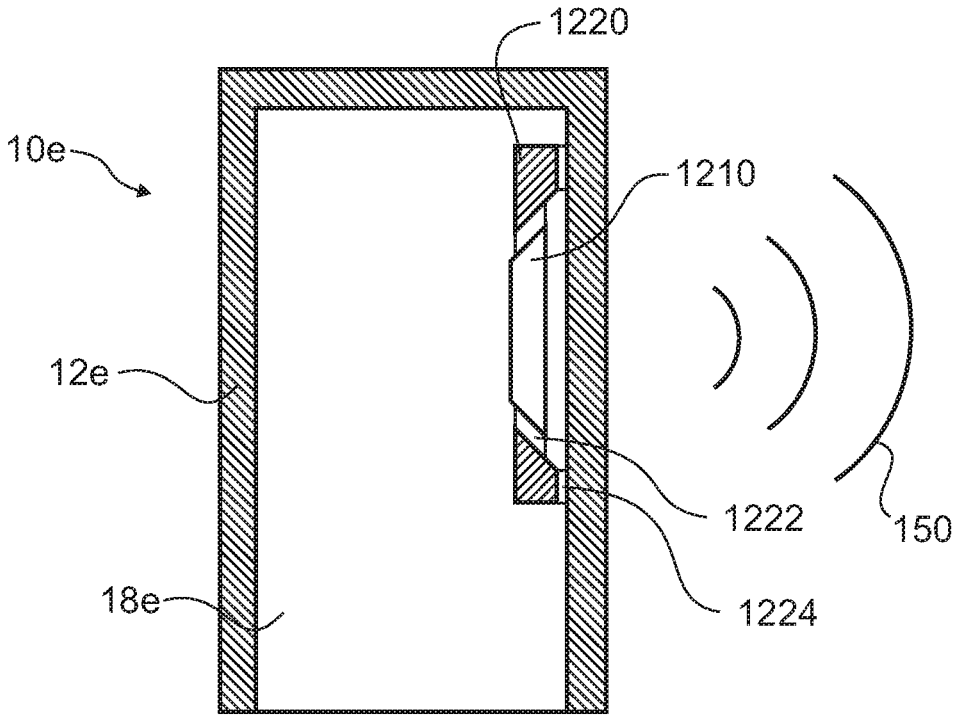
FIG. 12 shows a consumer electronics device including a substantially sealed casing and an integrated loudspeaker assembly attached thereto in accordance with the present disclosure.

FIG. 12 shows an integrated loudspeaker assembly embedded into the casing 12*e* of a consumer electronic device 10*e* in accordance with the present disclosure. The casing 12*e* may be substantially sealed (e.g. without acoustically substantial perforations, hermetically sealed, etc.) so as to form an enclosure 18*e* which is substantially acoustically isolated from a surrounding environment. The integrated loudspeaker assembly may include a speaker unit 1210, a mounting support 1220, a flexible support 1222, and an attachment means 1224 (e.g. an adhesive attachment means, a welding friendly surface coating, etc.) to attach the integrated loudspeaker assembly to the casing 12*e*. The mounting support 1220 may be configured to provide transfer of vibration from the speaker unit 1210 to the casing 12*e* so as to generate vibration in the casing 12*e* to operably produce an audible output signal 150. The enclosure 18*e* contributes a back volume for the speaker unit 1210.

The speaker unit 1210 may be connected to the mounting support 1220 directly or via the flexible support 1222. The flexible support 1222 may include mechanical properties suitable for optimizing structural vibration transmission from the speaker unit 1210 to the mounting support 1220.

The speaker unit 1210 may include a vibration source (e.g. a driver, a piezoelectric actuator, an electromagnetic shaker, etc.).

The integrated loudspeaker assembly may be attached to the casing 12*e* so as to excite one or more vibrations in the casing 12*e* during use. The placement of the integrated loudspeaker assembly may be chosen so as to maximize the influence of the speaker unit 1210 vibrations on the casing 12*e* vibrations.

The consumer electronic device 10*e* may include an audio enhancement system (AES) 800 in accordance with the present disclosure, configured to accept an input signal 801 from a source located within the consumer electronic device 10*e* and to communicate an output signal 835 to the speaker unit 1210. The audio enhancement system (AES) may be configured to compensate for the back volume in the output signal.

It will be appreciated that additional advantages and modifications will readily occur to those skilled in the art. Therefore, the disclosures presented herein and broader aspects thereof are not limited to the specific details and representative embodiments shown and described herein. Accordingly, many modifications, equivalents, and improvements may be included without departing from the spirit or scope of the general inventive concept as defined by the appended claims and their equivalents.

What is claimed is:

1. A cellular phone comprising:

a casing defining an enclosure;

an integrated loudspeaker assembly placed within the enclosure, wherein the casing comprises one or more perforations, the perforations configured to communicate an audio signal across the casing to a surrounding environment, and wherein the integrated loudspeaker assembly comprises a speaker unit and a mounting support, the mounting support configured to attach the speaker unit to the casing so as to form an air-tight seal and acoustically isolate the perforations from the enclosure, the enclosure forming a back volume for the speaker unit; and an audio enhancement system configured to accept an input signal from a source located within the cellular phone and to communicate an output signal to the speaker unit, the audio enhancement system configured to compensate for the back volume in the output signal.

2. The cellular phone in accordance with claim 1, wherein the speaker unit comprises a film speaker.

3. The cellular phone in accordance with claim 1, wherein the integrated loudspeaker assembly is attached to the casing at a plurality of points to enhance structural rigidity thereof.

4. The cellular phone in accordance with claim 1, further comprising a waveguide to communicate the audio signal between the speaker unit and the perforations.

5. The cellular phone in accordance with claim 1, wherein the integrated loudspeaker assembly comprises a protruding member that protrudes through the casing so as to provide a supporting leg for the cellular phone.

6. The cellular phone in accordance with claim 5, wherein the protruding member is configured to transfer vibration from the speaker unit to an external support surface located outside the cellular phone.

7. The cellular phone in accordance with claim 1, further comprising a waveguide to communicate the audio signal between the speaker unit and the perforations, wherein the waveguide has one or more acoustic anomalies, and wherein the audio enhancement system is configured to compensate for at least one acoustic anomaly thereof.

8. The cellular phone in accordance with claim 7, wherein the audio enhancement system comprises a parametrically configurable processing block configured to provide compensation of the back volume.

9. The cellular phone in accordance with claim 8, wherein the audio enhancement system comprises one or more reconfigurable parameters configured to adjust compensation of the back volume.

10. A consumer electronic device comprising:

a casing, wherein the casing defines an enclosure that is substantially acoustically isolated from a surrounding environment;

a loudspeaker assembly, wherein the loudspeaker assembly is attached to the inside of the casing, wherein the loudspeaker assembly includes a speaker unit, and wherein the enclosure forms a back volume for the speaker unit;

a signal source, located inside the casing; and an audio enhancement system, wherein the audio enhancement system is connected to the signal source to receive an input signal therefrom, wherein the audio enhancement system is connected to the speaker unit to supply an output signal thereto, and wherein the audio enhancement system is configured to compensate for the back volume in generating the output signal from the input signal.

11. The consumer electronic device in accordance with claim 10, wherein the casing is substantially sealed.

12. The consumer electronic device in accordance with claim 10, wherein the loudspeaker assembly includes a mounting support, which is attached to the inside of the casing.

13. The consumer electronic device in accordance with claim 12, wherein the loudspeaker assembly further includes a flexible support, connecting the speaker unit to the mounting support.

14. The consumer electronic device in accordance with claim 12, wherein the speaker unit is connected directly to the mounting support.

15. The consumer electronic device in accordance with claim 12, wherein the mounting support is configured to provide transfer of vibration from the speaker unit to the casing.

* * * * *